US007377882B2

(12) United States Patent
Watterson et al.

(10) Patent No.: US 7,377,882 B2
(45) **Date of Patent: *May 27, 2008**

(54) METHOD AND APPARATUS FOR TREADMILL WITH FRAMELESS TREADBASE

(75) Inventors: Scott R. Watterson, Logan, UT (US); William T. Dalebout, Logan, UT (US); Travis Sip, Wellsville, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/440,828

(22) Filed: May 25, 2006

(65) Prior Publication Data

US 2006/0217236 A1 Sep. 28, 2006

Related U.S. Application Data

(60) Continuation of application No. 10/804,715, filed on Mar. 19, 2004, now Pat. No. 7,052,442, which is a division of application No. 09/947,938, filed on Sep. 6, 2001, now Pat. No. 6,743,153.

(51) Int. Cl.
*A63B 22/02* (2006.01)

(52) U.S. Cl. ..... 482/54

(58) Field of Classification Search ..... 482/51, 482/54; D21/669; 434/253
See application file for complete search history.

(56) References Cited

U.S. PATENT DOCUMENTS

| | | | | |
|---|---|---|---|---|
| 1,211,765 A | | 1/1917 | Schmidt | |
| 3,554,541 A | | 1/1971 | Seaman | 272/69 |
| 5,072,928 A | * | 12/1991 | Stearns et al. | 482/54 |
| 5,088,729 A | | 2/1992 | Dalebout | 272/69 |
| 5,336,144 A | | 8/1994 | Rodden | 482/54 |
| 5,382,207 A | | 1/1995 | Skowronski et al. | 482/54 |
| D358,436 S | * | 5/1995 | Piaget et al. | D21/669 |
| 5,433,679 A | | 7/1995 | Szymczak et al. | 482/54 |
| 5,484,362 A | | 1/1996 | Skowronski et al. | 482/54 |
| 5,591,106 A | * | 1/1997 | Dalebout et al. | 482/54 |
| 5,599,259 A | | 2/1997 | Skowronski et al. | 482/54 |
| 5,613,856 A | * | 3/1997 | Hoover | 434/253 |
| 5,679,101 A | | 10/1997 | Magid | 482/54 |
| 5,709,632 A | | 1/1998 | Socwell | 482/54 |
| 5,752,897 A | | 5/1998 | Skowronski et al. | 482/54 |
| 5,772,560 A | * | 6/1998 | Watterson et al. | 482/54 |
| 5,897,461 A | * | 4/1999 | Socwell | 482/54 |
| 6,053,848 A | * | 4/2000 | Eschenbach | 482/54 |
| 6,095,951 A | | 8/2000 | Skowronski et al. | 482/54 |

(Continued)

FOREIGN PATENT DOCUMENTS

CA WO 03/022370 3/2005

(Continued)

*Primary Examiner*—Stephen R. Crow

(57) ABSTRACT

A method and apparatus for a treadmill having a frameless treadbase. The treadmill is lightweight and inexpensive. A preferred embodiment features an arched deck. The arched deck has a first end, a second end, and an intermediate portion, wherein the intermediate portion is has an upward incline or convex arch. The arched deck provides intrinsic cushion and incline. The arched deck maintains a convex arch independent of any structure in the treadmill. Additionally, the arched deck is connected to a front support and a rear support, the front support being independent from the rear support.

19 Claims, 8 Drawing Sheets

U.S. PATENT DOCUMENTS

| | | | | |
|---|---|---|---|---|
| 6,174,267 | B1 | 1/2001 | Dalebout et al. | 482/54 |
| 6,461,275 | B1 * | 10/2002 | Wang et al. | 482/8 |
| 6,743,153 | B2 * | 6/2004 | Watterson et al. | 482/54 |
| 7,052,442 | B2 | 5/2006 | Watterson et al. | 482/54 |

FOREIGN PATENT DOCUMENTS

| | | | |
|---|---|---|---|
| EP | 0403924 | B1 | 4/1995 |
| EP | 0504649 | B1 | 5/1995 |

* cited by examiner

METHOD AND APPARATUS FOR TREADMILL WITH FRAMELESS TREADBASE

CROSS-REFERENCE TO RELATED APPLICATIONS

This application is a continuation of application Ser. No. 10/804,715, filed on Mar. 19, 2004 now U.S. Pat. No. 7,052,442, entitled "Method and Apparatus for Treadmill with Frameless Treadbase", which is incorporated herein by reference in its entirety, and which is a divisional of application Ser. No. 09/947,938, filed on Sep. 6, 2001 now U.S. Pat. No. 6,743,153, entitled "Method and Apparatus for Treadmill with Frameless Treadbase," to Watterson, et al," which is incorporated herein by reference in its entirety.

BACKGROUND OF THE INVENTION

1. The Field of the Invention

The present invention relates to exercise equipment. More particularly, the present invention relates to an improved treadmill.

2. The Prior State of the Art

The desire to improve health and enhance cardiovascular efficiency has increased in recent years. This desire has been coupled with a desire to exercise in locations which are compatible with working out within a limited space, such as within an individual's home or exercise gym. This trend has led to an increased desire for the production of exercise equipment.

A long list of studies suggests that walking and running relieves stress and reduces the risk of heart disease, osteoporoses, high blood pressure and other cardiovascular diseases. As a result, treadmills are recommended for people of different ages and physical abilities, including elderly people, people with a heart condition, overweight as well as young healthy people who want to improve their cardiovascular abilities. Thus, treadmills have been produced that can be used for either running or walking indoors such as at home or in the office.

A typical treadbase requires that the deck be affixed to a frame. Such a frame usually includes front support, a rear support, and lateral elongated members connecting the front support and rear support. Such treadbases are typically heavy and cumbersome.

Furthermore, the shock experienced from the user's step on typical treadmills is reflected by the deck back to the foot, ankle and leg of the user in a similar manner as the reactive forces are imposed on a walker, a jogger or a runner exercising on a paved surface or a sidewalk. Over long periods of time, the shock experienced by the user can have detrimental effects to the joint of the user. Thus, some type of cushioning mechanism is advantageous. However, typical forms of cushioning require additional assembly and parts and require a frame structure that incorporates the desired cushioning method.

In addition, many treadmills implement incline mechanisms in order to provide a greater aerobic workout. However, such incline mechanisms typically require additional parts, again resulting in an increase in manufacturing cost.

BRIEF SUMMARY AND PRINCIPAL OBJECTS OF THE INVENTION

It is a general object of the present invention to provide an apparatus and method of manufacturing an improved treadmill.

It is another object of the present invention to provide an apparatus and method of manufacturing an improved tread base.

It is another object of the present invention to provide a treadmill having improved cushioning.

Also an object of the present invention is to decrease complexity in the manufacturing of an improved tread base by providing a simplified method of manufacturing.

A related object of the invention is to provide a simplified incline mechanism.

Similarly, it is a further object of the invention to provide an improved cushioning mechanism.

Accordingly, one embodiment of the present invention comprises a front support, a rear support, and a deck disposed between the front support and the rear support, wherein the front support and rear support are connected to each other only by each being connected to the deck. This frameless treadbase can provide improved cushioning, is lightweight and does not require an expensive, complex frame.

Since the deck is disposed between the front and rear supports and no frame is employed, the rear portion of the treadbase can be displaced by the force of the user ambulating on the deck of the treadmill. This feature provides an improved cushioning dynamic.

Furthermore, in one embodiment, the deck is upwardly arched. The arched deck maintains a convex arch when viewing the apparatus from the top. The convex arch is independent of the support structure of the treadmill. The arched deck assists to accomplish the goals of providing a lightweight, relatively unencumbered treadmill having a frameless treadbase, while maintaining excellent performance characteristics. For example, the arch maintains a natural incline.

The front support and rear support comprise rollers about which is disposed an endless belt train. Thus, the deck obviates the need for a frame because it can be supported by the front support and rear support alone. Decks employed in the present invention may be pliable and resilient, providing cushion for the user by deflecting upon impact of the user's footfall, thus resulting in less impact on the runner's joints. The slightly convex arch also provides an intrinsic incline allowing the user a more challenging workout. The present invention can thus provide cushioning, inclination, and fewer components.

Thus, those skilled in the art will appreciate the simplicity of the manufacturing design of the present invention in light of this disclosure. One skilled in the art can also appreciate that the present invention can decrease time and cost for manufacturing a treadmill.

These and other objects, features and advantages of the present invention will be set forth in the description which follows, and in part will be more apparent from the detailed description of a preferred embodiment, and/or from the appended claims, or may be learned by actual practice of the invention.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention contemplates an apparatus for a lightweight treadmill having a frameless treadbase. The deck is disposed between front and rear supports and no frame is employed. Thus, the rear portion of the treadbase can be displaced by the force of the user ambulating on the deck of the treadmill. This dynamic provides an improved cushioned surface. The treadmill avoids the need for a heavy, expensive frame component. The preferred treadmill has an arched deck.

The present invention provides cushioning and inclination without the numerous parts that were previously necessary in the art. Additionally, the novel design of the present invention provides a convenient, inexpensive method of manufacturing.

By way of example and not limitation, the invention is described by making reference to figures illustrating a general environment in which the invention may be implemented, and to diagrams that illustrate the structure of embodiments used to implement the apparatus. The diagrams should not be construed as limiting of the present invention's scope, but as illustrating an example of certain presently understood embodiments of the invention.

Figure 1:
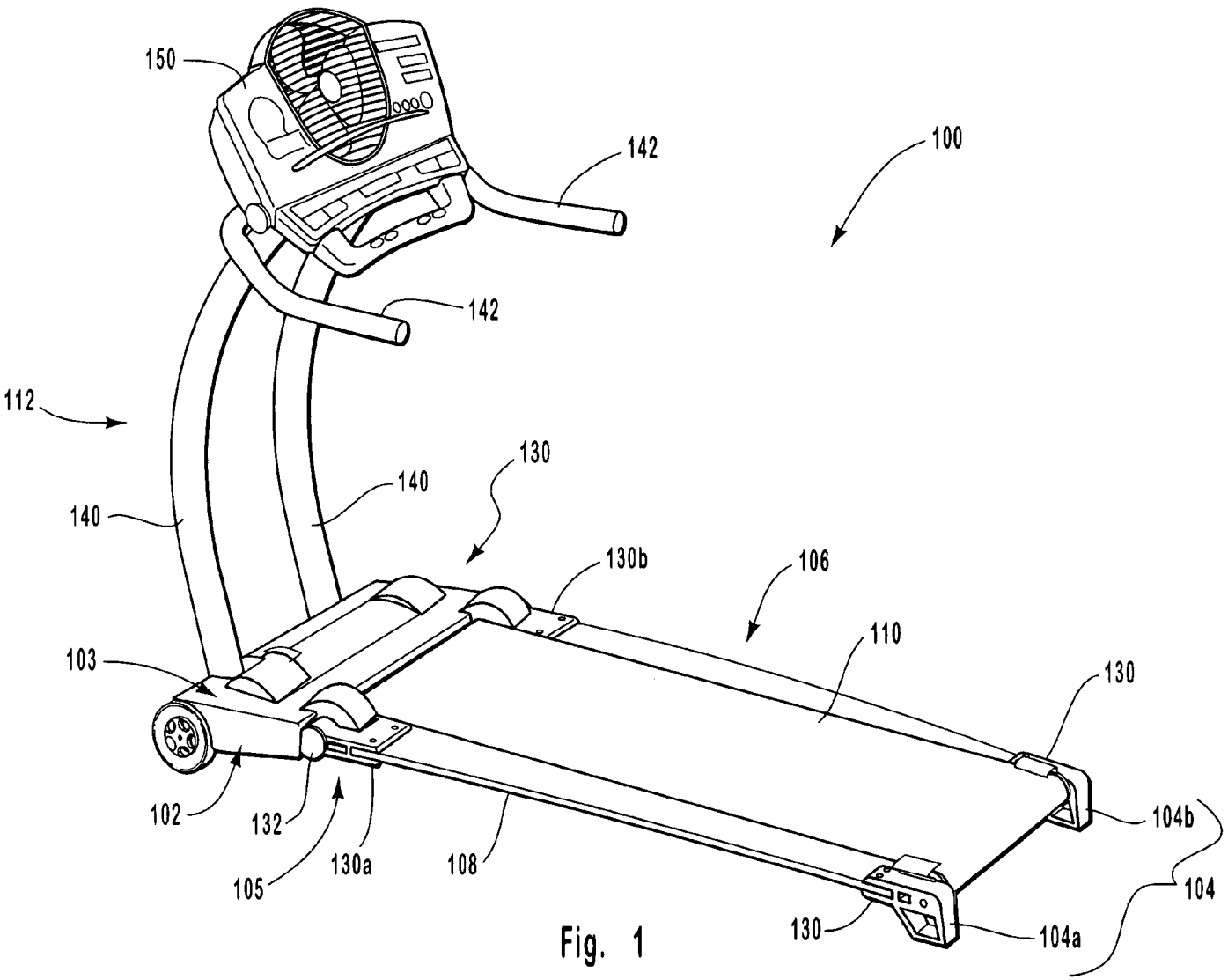
FIG. 1 is a perspective view of an embodiment of the present invention showing a treadmill having a frameless treadbase.
Figure 2:
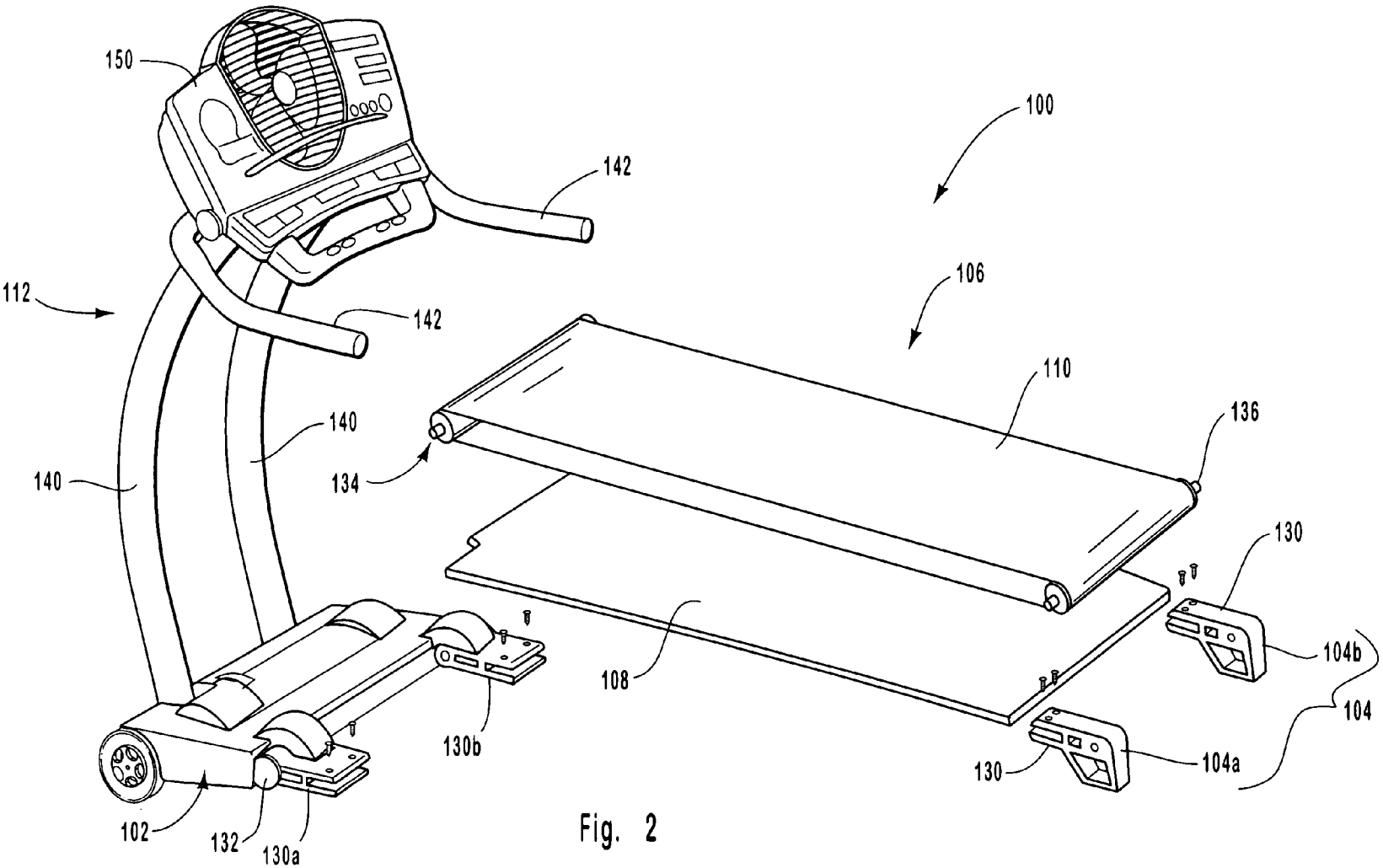
FIG. 2 is an exploded perspective view of the treadmill embodiment of FIG. 1.

Turning now to the drawings, FIGS. 1 and 2 show an exemplary representation of an embodiment of the present invention indicated generally as treadmill 100. Treadmill 100 comprises a frameless treadbase 106 comprising a rear support 104, a moveable portion 105 of a front support 102, and a deck 108. Deck 108 is disposed between front support 102 and rear support 104.

Front support 102 also comprises a fixed portion 103. A handrail assembly 112 extends upwardly from a fixed portion 103 of front support 102. Treadbase 106 is movably connected to the fixed portion 103 of front support 102, such that the treadbase 106 can be selectively positioned in an upper, storage position (FIG. 5) or a lower, operational position (FIGS. 1-2). In another embodiment, the front support comprises a one-piece support, e.g., a support without moving parts.

As shown, front support 102 and rear support 104 are connected to each other only by each being connected to deck 108. This independence of the supports 102, 104 enables the supports to be employed without the use of an extensive frame. As one advantage, the independence of the supports 102, 104 enables the rear support to deflect as the user ambulates on the treadmill. As will be discussed in greater detail, this can significantly increase the flexibility of the treadmill because the flexibility of the deck is not limited by the rigidity of an elongate frame. This embodiment also provides an inexpensive, lightweight method for manufacturing, maneuvering and storing a treadmill.

As shown in FIGS. 1 and 2, tread base 106 is comprised of an arched deck 108 upon which is trained an endless belt 110. The arched deck 108 assists to accomplish the goals of providing a cushioned, lightweight, inexpensive, inclined treadmill, while still maintaining excellent performance characteristics. Advantageously, the arched deck has a slightly upward arch, i.e., a slightly convex arch when viewing the arched deck from the top. Preferably, the arched deck is flexible and resilient.

One advantage of the arched deck is that the arched deck provides an incline mechanism that does not require complex components. The preferred arched deck also provides cushioning to relieve pressure and strain on the joints as the user ambulates thereon. Additionally, the arched deck provides for simplicity of design that has heretofore been unknown in the art. Specifically, employment of the arched deck results in less components to achieve cushioning and incline, representing a significant improvement in the art.

The arched deck 108 is supported by front and rear supports 102, 104, as mentioned. As shown in FIGS. 1 and 2, the rear support 104 of FIGS. 1 and 2 comprises first and second rear support members 104*a*, 104*b* and a rear roller 136 extending therebetween.

Front support 102 comprises a fixed portion 103 that is designed to remain on the support surface during use and storage and a moveable portion 105 that couples to the deck 108 and is pivotally coupled to the fixed portion 103. Moveable portion 105 comprises first and second support members 130*a*, 130*b* and a front roller 134 extending therebetween.

Those skilled in the art will recognize in light of this disclosure that front support 102 and rear support 104 may comprise various structures suitable for support purposes. For example, front support 102 or rear support 104 may comprise a wheel mechanism to increase mobility and portability of treadmill 100 such as is shown at the front corners of front support 102. Front support 102 or rear support 104 may also comprise a plurality of bases, legs, or feet to facilitate stability.

As will be discussed in additional detail, the rear and/or front support may comprise a sliding or rolling member such that the support can deflect upon use of the treadmill. In one embodiment, the front support is configured to remain in one set location during use, while the rear support is configured to deflect during use. This may be achieved, for example, by employing (i) a fixed portion 103 that remains stably on the support surface during use; and (ii) one or more or one or more sliding or rolling members at the rear support that moves upon ambulation of a user, as discussed in greater detail below.

In one embodiment, treadmill 100 comprises a handrail assembly 113 extending upwardly from the fixed portion 103 of front support 102. There are a variety of handrail assemblies and handlebars suitable for treadmill 100. As shown in FIG. 1, handrail assembly 112 generally comprises at least one handrail 140 extending upward from front support 102. Connected to handrails 140 may be handlebars 142 which extend toward the runner to provide upper body balance and support. Handrails 140 support a console 150. Console 150 may contain a variety of conveniences for the runner such as cup holders, book holders, control keypads for computerized mechanisms, a fan(s), as shown, and the like.

Figure 3:
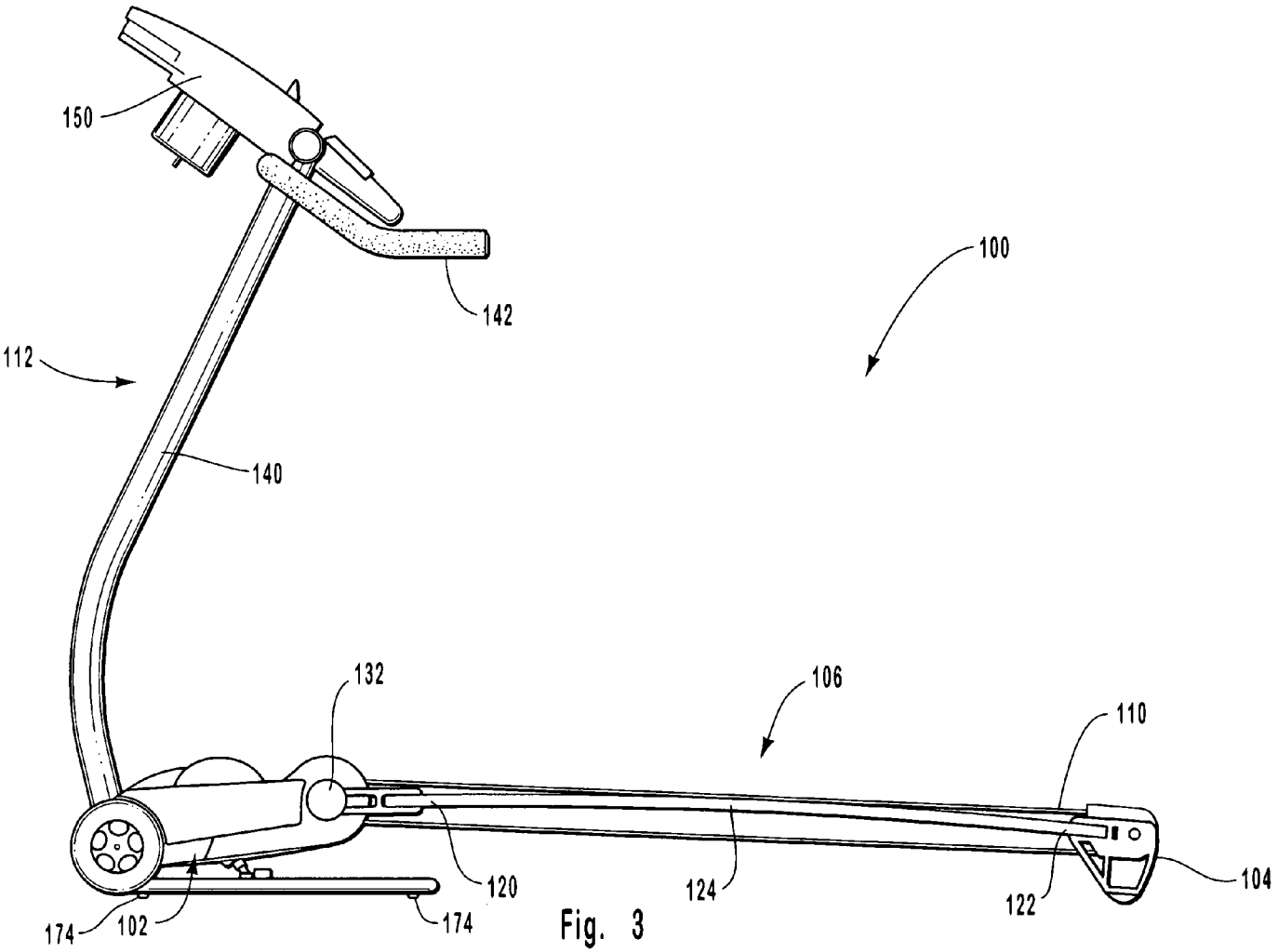
FIG. 3 is a side view of the treadmill of FIG. 1.

Turning now to another aspect of the present invention, FIGS. 1-3 show treadbase 106 of the present invention. Treadbase 106 comprises a deck 108 and an endless belt 110 positioned about the deck 108. As best shown in FIG. 2, front support 102 and rear support 104 comprise front roller 134 and rear roller 136, respectively, such that endless belt 110 can be trained thereon. Thus, during operation, the user may ambulate upon the endless belt 110. Those skilled in the art will also recognize that front support 102 may comprise a motor movably coupled to the front roller 134 such that the rotation of endless belt 110 may be automated and programmed to the user's desire. Thus, treadmill 100 is optionally a motorized treadmill.

An advantage of employing the arched deck 108 and front and rear supports 102, 104 as described above can readily be seen in that no frame, as traditionally required in the art, is necessary. In other words, the arched deck 108 is sufficiently supported by coupling the arched deck to the front support 102 and rear support 104. No additional components, such as crossbars, supports, or lateral bars, are necessary. Front support 102 and rear support 104 are maintained independent of one another such that there are no additional components connecting the front and rear support, the coupling mechanisms being sufficient to hold up the arched deck 108. The rear support can deflect independently from the front support such that improved cushioning is achieved.

Yet another advantage of the arched treadmill deck of the present invention is that the spring inherent in the preferred arched deck absorbs contact made by the user as the user ambulates on the treadbase. The deck may accommodate different gaits of different users because the deck can flex slightly for lighter users or can flex more for heavier users.

During assembly, the arched deck 108 is placed between the front support 102 and rear support 104. FIG. 2 illustrates an exploded view of one embodiment, showing components for attaching the arched deck 108 to the front support 102 and rear support 104. One skilled in the art will recognize that either front support 102 or rear support 104 may comprise a number of suitable components for coupling arched deck 108 to a support and that the figures are for illustrative purposes and are not to be limiting in any way.

As shown in FIGS. 1 and 2, front support members 132*a-b* and rear support members 104*a-b* may comprise partially U-shaped brackets attached by a rivet, bolt, screw, adhesive or other coupler to the deck. Alternatively, the deck may be attached to one or more components of the front support and/or rear support by molding, e.g., by forming the deck and front support and/or rear support (or portions thereof) as one integrally molded unit, such as through molding of a plastic material to form an integral deck and front and/or rear support or portions thereof. For example, in one embodiment, front members 130*a*, 130*b* and/or rear members 104*a*, 104*b* are integrally molded with deck 108 through the use a plastic and/or other material.

Figure 5:
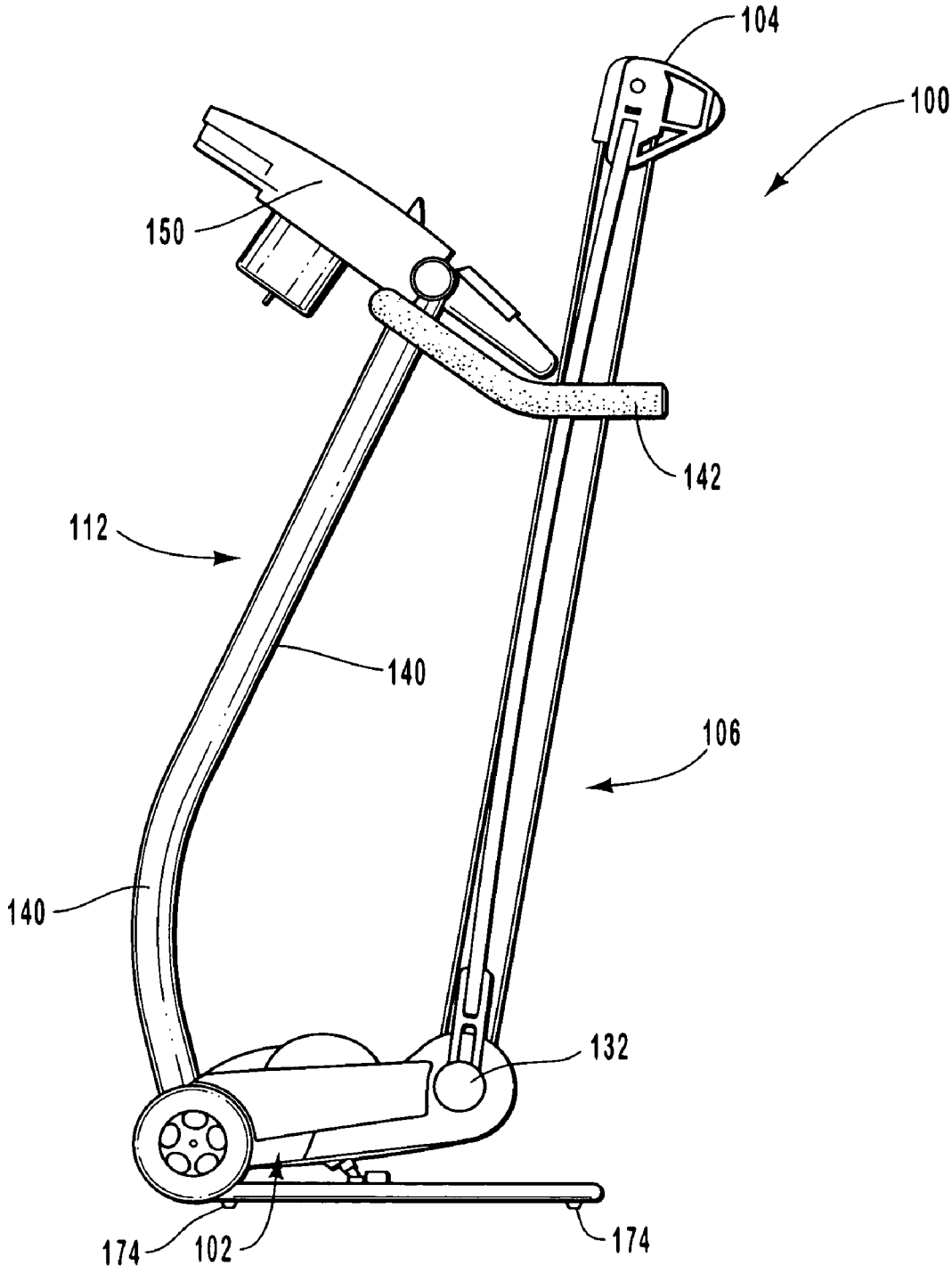
FIG. 5 is a side view of the treadmill of FIG. 1 in an upright position.

Treadmill 100 may contain a folding mechanism. As shown in FIGS. 1, 3, and 5, treadbase 106 is rotatably connected to the fixed portion 103 of front support 102 at pivot 132. First and second support members 130*a*, 130*b* are rotatably coupled to fixed portion 103. Thus, treadbase 106 is reorientable between a first position, in which the endless belt 110 is positioned for operation by a user (FIG. 3), and a second position, in which the second end 122 of arched deck 108 is positioned or moved toward the upright structure (FIG. 5). Arched deck 108 may comprise a lightweight material such that the user can easily lift arched deck 108 into the upright position. However, treadmill 100 may also contain any number of lift assists such as (i) the arched deck 108 being configured to act as a counter weight, (ii) springs, or (iii) gas shocks.

Although the deck 108 of FIG. 2 has opposing notches at a front end 120 thereof, in another embodiment, the front end is straight, i.e., without side notches, although a variety of different embodiments may be employed in the present invention.

Also in one embodiment, to reduce friction between the belt 110 and deck 108 as the user exercises on treadmill 100, a friction reducing layer such as a thin MYLAR sheet is mounted on the upper surface of deck 108 during assembly. The sheet is mounted on the upper surface of deck 108 under the belt 110 and may be lubricated (or the belt may be lubricated) to additionally reduce friction.

Figure 4:
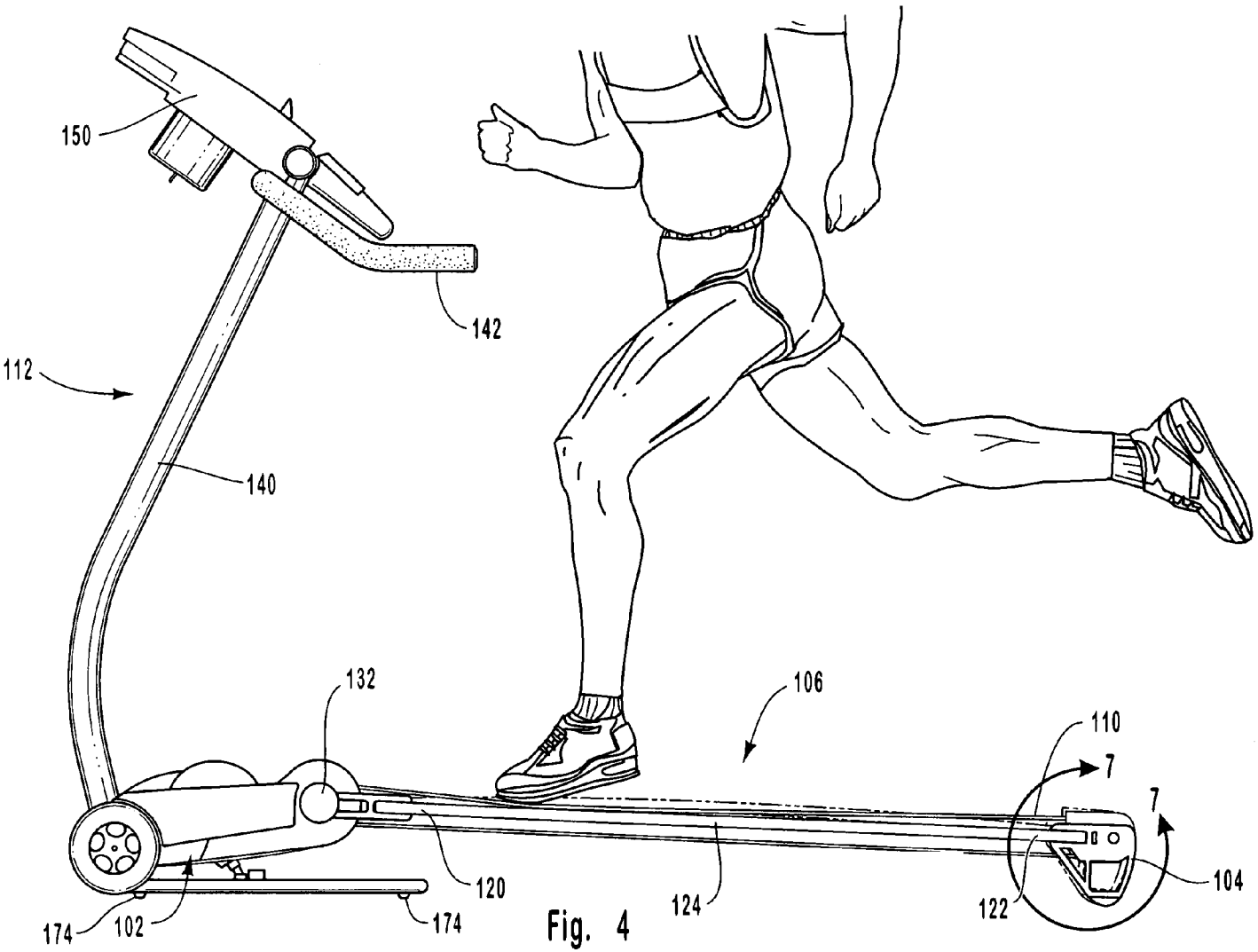
FIG. 4 is a side view of an embodiment of the treadmill of the present invention showing the deflection of the arched deck when in use.
Figure 6A:
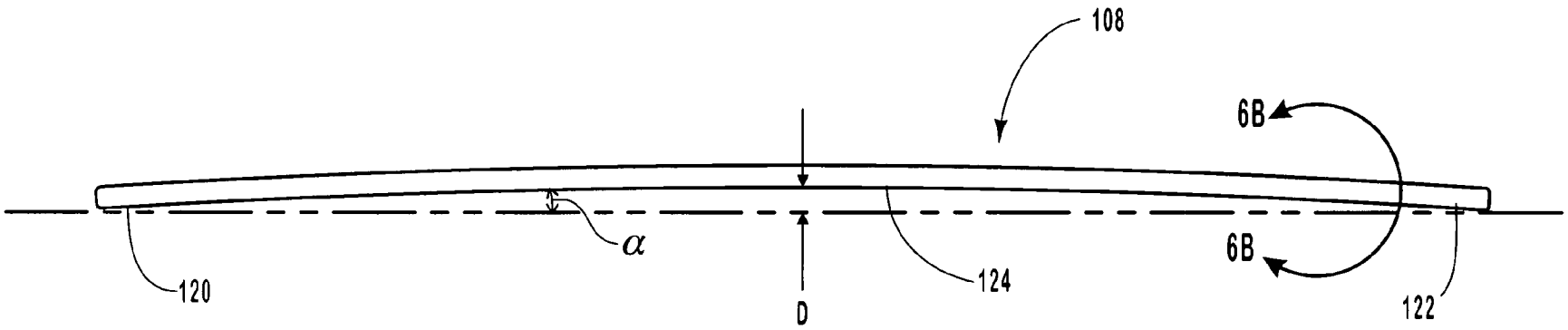
FIG. 6A is a side view of an embodiment of the arched deck illustrating the convex nature of the arched deck.

Turning now to arched deck 108 shown in FIGS. 3, 4 and 6A, arched deck 108 is configured such that it independently maintains a convex arch (i.e., an upward arch). In other words, before assembling treadmill 100, the arched deck 108 is manufactured such that it has a convex arch. Arched deck 108 has a first end 120, a second end 122, and an intermediate portion 124 therebetween. First end 120, second end 122, and intermediate portion 124 are configured such that they maintain a convex, i.e., upwardly inclined arch.

For example, as shown in FIG. 6A, when placed on a horizontal axis, first end 120 and second end 122 are lower than intermediate portion 124 by distance D. While FIG. 6A is illustrative of the convex nature of the arched deck 108, the treadmill is not limited to the first end 120 being horizontally aligned with second end 122. For example, first end 120 may be slightly or substantially raised above second end 122 without departing from the spirit of the present invention.

Furthermore, arched deck 108 is not limited to a symmetrical arch, but may also comprise an asymmetrical arch. An arched deck of the present invention may have a variety of different shapes, such as: (i) a concave or (ii) S-shape, such that a portion thereof has a convex arch, while another portion has a concave arch.

In one embodiment, when formed, the distance D shown in FIG. 6A is in the range of about 0.25 inch to about 1 inch. In another embodiment, the distance D is in the range of about 0.375 inch to about 0.75 inch, such as about 0.45 inch±0.03 inch.

In one example, distance D is about 0.45±0.03 inch and the length of the treadmill deck is about 46.56 inches. However, these lengths and heights are provided by way of example only and the actual amounts may vary dramatically depending upon the particular desired application. Depending on the total length of arched deck 108, angle $\alpha$ will vary. Angle $\alpha$ contributes to the natural incline of the arched deck 108. For example, in one embodiment the angle $\alpha$ is in the range of about 0.62 degrees to about 2.46 degrees (e.g., about 1.08 degrees), although a variety of different angles of inclination may be employed.

As another example, in one embodiment, a 500 pound load deflects the deck approximately 0.75 inch to approximately 1 inch. However, one skilled in the art will recognize that the present invention is not limited to these ranges which are presented by way of example and not by limitation.

While it is possible to employ a rigid deck in the present invention that does not deflect under pressure, in one embodiment, the deck is sufficiently flexible that the deck 108 provides an intrinsic flexibility when the user exercises thereon. This may be achieved through the use of a deck comprising wood, for example.

As shown in FIG. 4, in one embodiment, when a user applies pressure to the intermediate portion 124 of one such flexible arched deck, the intermediate portion deflects somewhat under such pressure. Depending on the stiffness of the arched deck, the arched deck may even deflect beyond the horizontal axis, resulting in a slightly concave shape when pressure is applied, but springing back to the convex shape of FIGS. 3 and 6 when the pressure is removed. Thus, the present invention obviates the need for additional cushioning mechanism components. In one embodiment, the flexibility of arched deck 108 can be selectively modified. For example, the material of the deck may be modified accordingly to respond to heavier or lighter pressures, or the treadmill 100 may contain an adjusting mechanism for adjusting the flexiblity.

One skilled in the art will recognize the advantages of having a cushioning mechanism as previously described. Many prior art cushioning mechanisms require multiple parts which often result in wear and breakdown after extended use. The cushioning mechanism embodiment described above can provide the user with an inherent bounciness which is gentle on the joints without requiring the additional costs of a cushioning mechanism.

Figure 7:
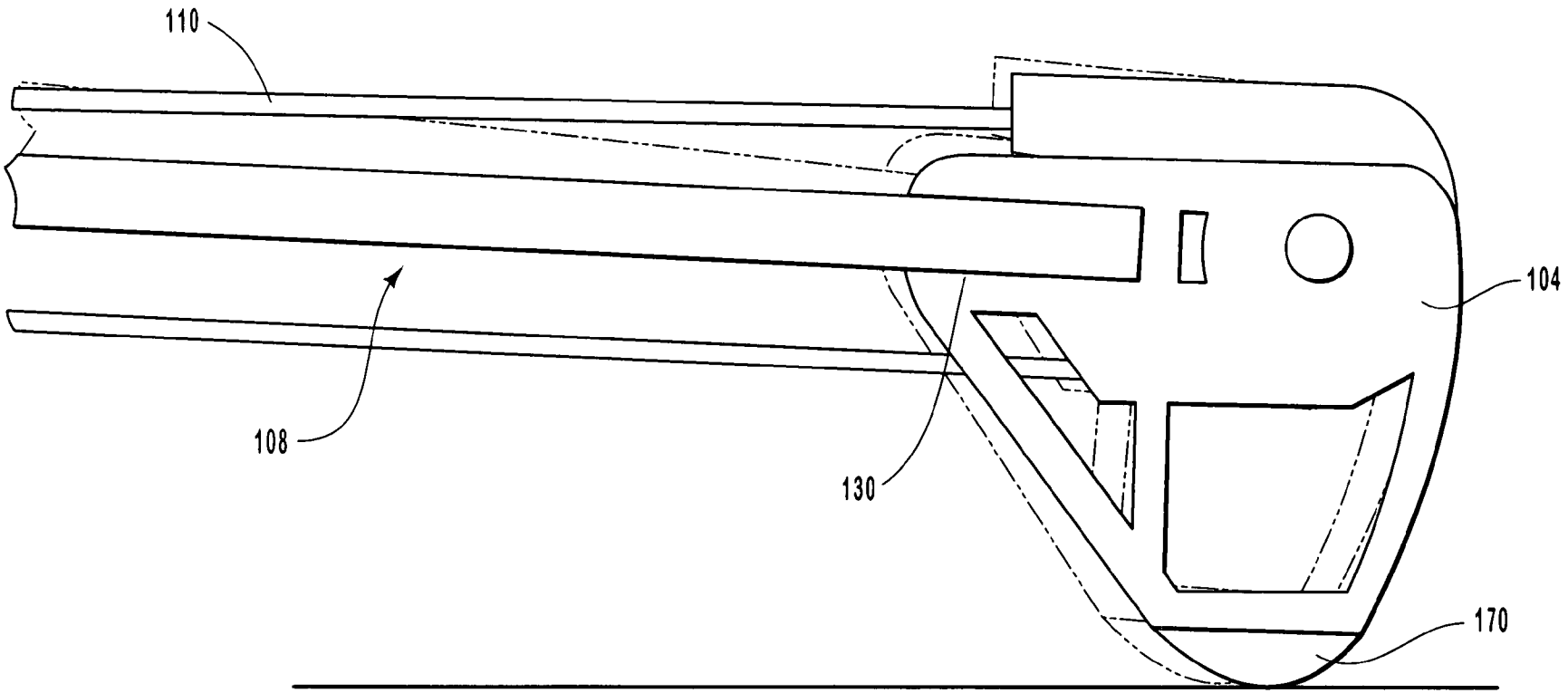
FIG. 7 is an exploded view of a rear support of the present invention as shown in FIG. 4 taken along line 7-7 of FIG. 4.
Figure 8:
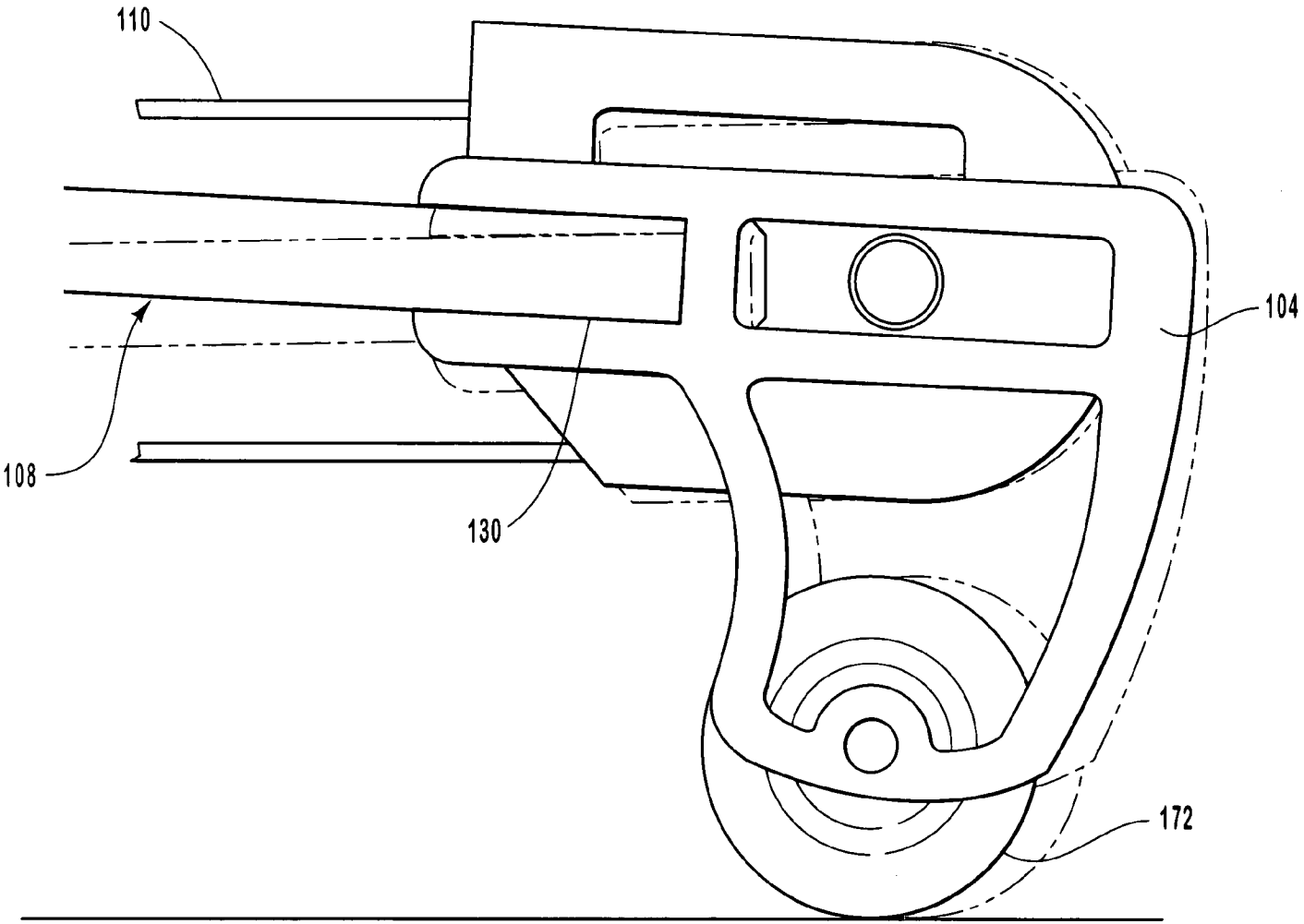
FIG. 8 is an exploded view of an alternate rear support of the present invention as in FIG. 4 taken along line 7-7 of FIG. 4.

As mentioned, rear support 104 may have a tendency to deflect as the user exercises upon the treadmill. This occurs because of the frameless nature of the treadmill. This phenomenon is shown more clearly in FIGS. 4, 7 and 8. In FIGS. 4 and 7, the displaced view is shown in full lines while the non-displaced view is shown in phantom lines. In FIG. 8, the displaced view is shown in phantom lines while the non-displaced view is shown in full lines.

Preferably, rear support 104 is configured to have minimal traction on the portion that contacts the support surface. Thus, in one embodiment, rear support 104 in FIGS. 4 and 7 is configured with a glide 170 (e.g., comprising nylon and/or PVC) on the portion of rear support 104 that contacts the surface and slides thereon. For example, each rear support member 104*a-b* may include such a glide 170 thereon. Glide 170 may optionally comprise nylon, PVC, DELRIN, ultra high molecular weight polyethylene, or a variety of other materials, for example. Glide 170 allows the rear support 104 to glide back and forth on a support surface as the user exercises. In another embodiment, shown in FIG. 8, each rear support member 104*a-b* is configured to include a wheel 172 to roll back and forth during exercise. Advantageously, the glides 170 or wheels 172 add to the natural cushion of the tread base 106 because the rear support 104 is experiencing only minimal resistance with the surface and deflects during use. In one embodiment, the glide comprises a rounded disk.

Thus, one or more wheels and/or one or more glides are each examples of means for enhancing the deflection of the rear portion of the treadmill deck. One skilled in the art will recognize that other means for enhancing the deflection of the rear portion of the treadmill deck may be employed, such as a felt material or a lubricant on the portion(s) of rear support 104 that contacts the surface. A lubricant may also be used on the glide 170 to increase the slickness of the rear support 104. Optionally, a lubricious material, e.g., a material impregnated with a lubricant may be employed as at least the lower part of support 104, and is another example of means for enhancing the deflection of the rear portion of the treadmill deck.

In one embodiment, as shown in FIGS. 3-5, the front support includes a front set and a rear set of elastomeric feet members 174 that assist the front support to remain in one set location during use. Each set comprises a right foot member (not shown) and a left foot member 174. Feet members 174 are coupled to a lower surface of a platform at a lower portion of fixed portion 103.

Another advantage of an arched deck 108 is that the deck provides an intrinsic incline mechanism which can removes the need for any additional components to produce an inclining mechanism. Thus, the present invention can removes the need for an incline motor and the associated expense of assembly. However, the inherently inclined nature of the arched deck does not preclude the use of incline mechanisms commonly found in a number of treadmills, whether motorized or manual and one embodiment of the present invention has such an inclining mechanism.

While a single layer or material may be employed in the deck of the present invention, in one embodiment, the arched deck of the present invention comprises multiple layers of material. Such a process of forming such an arched deck may comprise an operator applying multiple layers of a material in a curved press. The press is designed to provide a suitable arch such that the arched deck, when formed, maintains the arch conferred by the press. The layers of material can be bonded together using a suitable bonding agent 166, such as an adhesive, cement or composite. Pressure, heat, and/or ultrasonic vibration or UV radiation (or both), can then be applied to seal the layers of material together until the bonding agent is strong enough to maintain the arched deck.

Figure 6B:
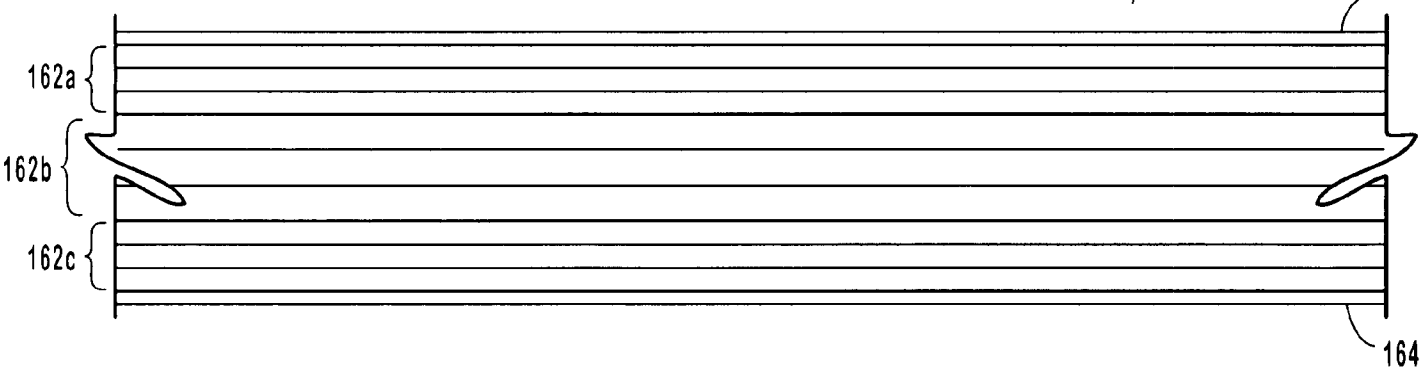
FIG. 6B is an enlarged cross-sectional view of a deck of the present invention shown in FIG. 6A taken along the line of 6B, illustrating a method of manufacturing the deck.

For example, as shown in FIG. 6B, arched deck 108 may have a top layer 160, an intermediate layer 162 (shown as multiple intermediate layers 162*a*, 162*b*, and 162*c*), and a bottom layer 164 being maintained together by bonding agent, e.g, an adhesive. The material may comprise a plywood laminate, poplar, maple, or any combination of suitable materials. Each layer may further be comprised of multiple layers of a particular material or combination of materials. One skilled in the art will also recognize that the arched deck 108 may comprise a single layer of material.

Specifically, in the embodiment shown in FIG. 6B, generally, three layers are shown—a top layer 160, an intermediate layer 162, and a bottom layer 164. One example of wood that may be employed for this embodiment will now be provided, although a variety of other embodiments may be employed.

By way of example, in one embodiment, top layer 160 is formed of one sheet of maple. In one example, the sheet is 1/34 inch in thickness. The intermediate layer 162 may comprises three layers of poplar. The first layer 162*a* may be composed of three sheets of poplar, each 1/16 inch in thickness. The second layer 162*a* may be composed of three sheets of poplar, each sheet having a thickness of 1/10 inch. The third layer 162*c* may be composed of three sheets of poplar, each having a thickness of 1/16 inch. The bottom layer 164 may comprise one sheet of maple having a thickness of 1/34 inch. The various layers are bonded together using a suitable bonding agent, such as an adhesive. The layers are held together in the press by pressure, heat, and/or ultrasonic vibration or UV radiation (or both) until they are cured and able to maintain a concave arch independent of any other structure. The deck may be formed according to known procedures for manufacturing plywood laminates, for example.

As mentioned, one skilled in the art will recognize in light of this disclosure that the forgoing example of multiple layers is presented by way of illustration and not by limitation and that other means may be employed to form the arched deck. For example, a—Another method for making the arched deck comprises twin sheet thermal forming. Such a method uses at least two layers of plastic formed in an arch. The layers of plastic are bonded together, leaving an elongated hollow cavity between the layers.

In another embodiment, a single layer is employed, such as a single plastic layer. In yet another embodiment, the deck is a single layer formed integrally with the rear and/or front support members, such as through a molding process.

A number of materials and methods are suitable to form arched deck 108 including, but not limited to wood, laminates, structural foam, glass, plastic, injection molded plastic, medium density fiber board, fiberglass, blow molding, spring steel and the like. Furthermore, a number of materials are suitable to form the front and rear support members of the present invention, such as aluminum extruded supports, plastic injection molded supports, die casted supports, structural foam, fiber glass, and the like.

For example, in one embodiment, the deck comprises an arched laminated wooden deck while the front and rear supports each comprise extruded brackets (comprising e.g., aluminum and/or plastic) that hold the respective rollers. In another embodiment, the deck comprises a one-piece molded deck with front and rear support members integrally coupled thereto. This deck with integral front and rear support members can be injection molded as one piece (e.g., with a plastic material), for example.

Additional examples of "arched decks" of the present invention as disclosed and claimed herein include convex arched decks (i.e., downwardly arching decks), decks having an S-shape (i.e. where the deck arches partially upward and partially downward, among a variety of other shapes.

Once formed, arched deck 108 maintains a concave arch independent of any other structure. The arched deck 108 may then be mounted onto front support 102 and rear support 104 such that the front support is independent of the rear support. The assembly process also comprises positioning an endless belt on said front and rear supports during the assembly process, such that the endless belt can rotate about the deck. Other components as herein disclosed may also be employed.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for making a treadmill having a frameless treadbase, the treadmill having a front support member and a rear support member, the treadmill also having an arched deck, the arched deck having a first end, a second end, and an intermediate portion between the first end and the second end, wherein the method comprises:

forming an arched deck such that, when placed on a horizontal axis, the first and second ends of the arched deck are positioned below the intermediate portion of the arched deck;

mounting the first end of the arched deck to the front support;

mounting the second end of the arched deck to the rear support; and positioning an endless belt on said front and rear support such that the endless belt can move around said arched deck.

2. The method of claim 1, further comprising maintaining the front support member independent from the rear support member.

3. The method of claim 1, wherein the deck comprises an arched deck, the arched deck having a first end, a second end, and an intermediate portion between said first end and said second end, said arched deck forming an upward arch, said first end being connected to said front support member and said second end being connected to said rear support member, wherein the front support member and the rear support member are independent from one another and wherein the arched deck is configured to maintain its arched shape independent of any other structure.

4. The method of claim 1, wherein said arched deck deflects when pressure is applied to said arched deck.

5. The method of claim 1, wherein said arched deck is an independently arched deck.

6. A method for making a treadmill having a frameless treadbase configured to enable a user to ambulate on the treadbase, the method comprising:

forming an arched deck;

connecting said deck to a front support and a rear support, wherein the front support is independent of the rear support such that the rear support can move relative to the front support when a user is ambulating on the treadbase; and positioning an endless belt on said front and rear support such that the endless belt can move around said deck.

7. A method as recited in claim 6, wherein said arched deck maintains a convex arch independent from said front support and rear support members.

8. A method as recited in claim 6, wherein the arched deck has a first end, a second end, and an intermediate portion between said first end and said second end, said arched deck forming an upward arch, said first end being connected to said front support member and said second end being connected to said rear support member, wherein the front support member and the rear support member are independent from one another and wherein the arched deck is configured to maintain its arched shape independent of any other structure.

9. A method for making a treadmill having a frameless treadbase configured to enable a user to ambulate on the treadbase, the method comprising:

providing an independently arched deck;

providing a front support and a rear support;

connecting said independently arched deck to said front support and said rear support; and positioning an endless belt about said front support and said rear support such that the endless belt can move around said deck.

10. A method as recited in claim 9, wherein the arched deck is configured to maintain its arched shape independent of any other structure.

11. A method as recited in claim 9, wherein forming a deck comprises forming an arched deck such that the arched deck independently maintains a convex arch.

12. A method as recited in claim 9, wherein the front support is independent from the rear support.

13. The method of claim 9, wherein said arched deck deflects when pressure is applied to said arched deck.

14. A treadmill having a frameless treadbase configured to enable a user to ambulate on the treadbase, the treadmill comprising:

an independently arched deck;

a front support and a rear support connected to the independently arched deck; and an endless belt positioned about said front support and said rear support such that the endless belt can move around said deck.

15. A treadmill as recited in claim 14, wherein the front support is independent from the rear support.

16. A treadmill as recited in claim 14, wherein the deck maintains its arch independently from the front and rear supports.

17. The treadmill of claim 14, wherein, when placed on a horizontal axis, a first end and a second end of the arched deck are positioned below an intermediate portion of the arched deck.

18. A method for making treadmill having a frameless treadbase configured to enable a user to ambulate on the treadbase, the treadmill method comprising:

providing an arched deck;

connecting a front support and a rear support to the arched deck; and positioning an endless belt on said front and rear support such that the endless belt can move around said arched deck, wherein the arched deck is configured to maintain its arched shape independent of any other structure.

19. A treadmill having a frameless treadbase configured to enable a user to ambulate on the treadbase, the treadmill comprising:

an arched deck;

a front support and a rear support connected to the arched deck; and an endless belt positioned on said front and rear support such that the endless belt can move around said arched deck, wherein the arched deck is configured to maintain its arched shape independent of any other structure.

* * * * *

UNITED STATES PATENT AND TRADEMARK OFFICE

CERTIFICATE OF CORRECTION

PATENT NO. : 7,377,882 B2
APPLICATION NO. : 11/440828
DATED : May 27, 2008
INVENTOR(S) : Watterson et al.

It is certified that error appears in the above-identified patent and that said Letters Patent is hereby corrected as shown below:

Column 1
Line 11, change “Treadbase”,” to --Treadbase,”--
Line 15, change “et al,”” to --et al.,--
Line 33, change “relieves” to --relieve--
Line 33, change “reduces” to --reduce--
Line 39, change “indoors such” to --indoors, such--

Column 2
Line 35, after “rollers” add --,--

Column 4
Line 59-60, remove “or one or more”
Line 64, change “113” to --112--

Column 5
Line 51, change “132*a*-*b*” to --130*a*-*b*--
Line 62, change “use a” to --use of--

Column 8
Line 14, change “removes” to --remove--
Line 17, change “removes” to --remove--
Line 56, change “comprises” to --comprise--

UNITED STATES PATENT AND TRADEMARK OFFICE

CERTIFICATE OF CORRECTION

PATENT NO. : 7,377,882 B2
APPLICATION NO. : 11/440828
DATED : May 27, 2008
INVENTOR(S) : Watterson et al.

It is certified that error appears in the above-identified patent and that said Letters Patent is hereby corrected as shown below:

Column 9
Line 8, change "a—Another" to --another--
Line 38, change "i.e. where" to --i.e., where--
Line 39, change "downward," to --downward),--

Signed and Sealed this

Seventeenth Day of November, 2009

David J. Kappos

David J. Kappos
*Director of the United States Patent and Trademark Office*